US011851927B2

(12) United States Patent
Nordieker et al.

(10) Patent No.: US 11,851,927 B2
(45) Date of Patent: Dec. 26, 2023

(54) FLAP FITTING FOR FURNITURE

(71) Applicant: HETTICH-ONI GMBH & CO. KG, Vlotho (DE)

(72) Inventors: Martin Nordieker, Hüllhorst (DE); Jens Poischbeg, Leopoldshöhe (DE); Ralf Tofall, Minden (DE)

(73) Assignee: Hettich-ONI GmbH & Co. KG, Vlotho (DE)

( * ) Notice: Subject to any disclaimer, the term of this patent is extended or adjusted under 35 U.S.C. 154(b) by 372 days.

(21) Appl. No.: 17/424,542

(22) PCT Filed: Jan. 30, 2020

(86) PCT No.: PCT/EP2020/052258
§ 371 (c)(1),
(2) Date: Jul. 21, 2021

(87) PCT Pub. No.: WO2020/157180
PCT Pub. Date: Aug. 6, 2020

(65) Prior Publication Data

US 2022/0098910 A1 Mar. 31, 2022

(30) Foreign Application Priority Data

Jan. 31, 2019 (DE) ..... 10 2019 102 491.9

(51) Int. Cl.
*E05F 5/02* (2006.01)
*E05D 11/10* (2006.01)
*E05D 3/06* (2006.01)

(52) U.S. Cl.
CPC ..... *E05D 11/1007* (2013.01); *E05D 3/06* (2013.01); *E05Y 2900/20* (2013.01)

(58) Field of Classification Search
CPC ..... E05D 5/02; E05D 5/08; E05D 5/0215; E05D 5/0223; E05D 5/0238;
(Continued)

(56) References Cited

U.S. PATENT DOCUMENTS 5,152,559 A * 10/1992 Henrichs ..... B64D 29/06 292/DIG. 31
6,398,272 B1 * 6/2002 Plummer ..... E05C 19/06 292/249

(Continued)

FOREIGN PATENT DOCUMENTS

DE 202014103519 U1 10/2015
DE 102017104169 A1 8/2018

(Continued)

OTHER PUBLICATIONS

Office Action dated May 30, 2022 in related/corresponding EP Application No. 20 703 187.3.

(Continued)

*Primary Examiner* — Chuck Y Mah
(74) *Attorney, Agent, or Firm* — PATENT PORTFOLIO BUILDERS PLLC

(57) ABSTRACT

A flap fitting for furniture has a lever mechanism with multiple levers for guiding a flap of the furniture. The lever mechanism is retracted at least partly into a housing of the lever fitting in a closed position. An auxiliary element is releasably secured to one of the levers of the lever mechanism. The auxiliary element has a locking section that blocks a movement of the lever relative to the housing in a locking position. After the lock of the auxiliary element is released, the auxiliary element is pivotally secured to one of the levers of the lever mechanism in order to extend the lever mechanism out of the opening by pulling the auxiliary element.

14 Claims, 8 Drawing Sheets

Figure 1:
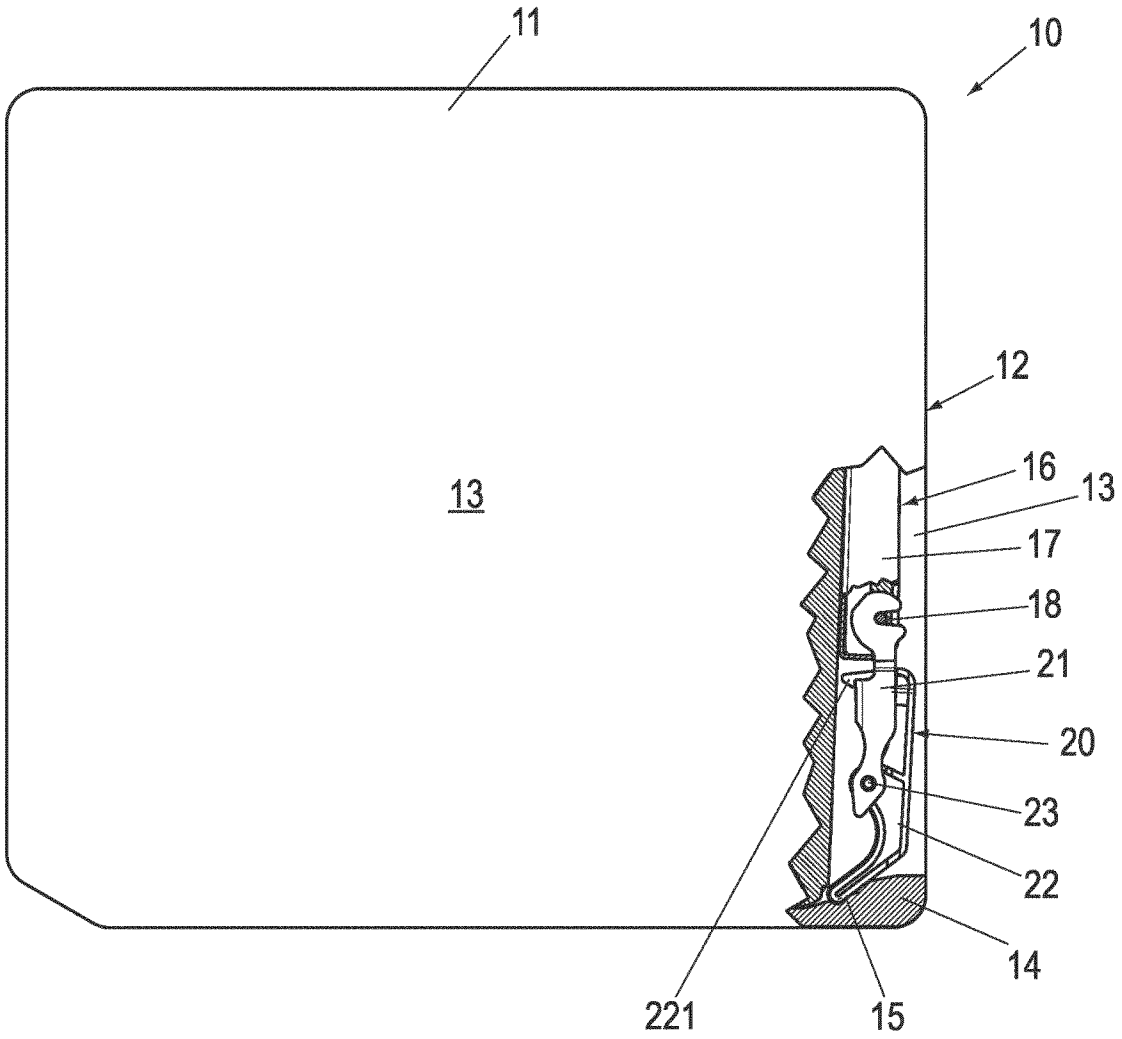

(58) Field of Classification Search
CPC ..... E05D 5/0276; E05D 5/046; E05D 5/16; E05D 7/0009; E05D 7/10; E05D 7/12; E05D 7/125; E05D 7/123; E05D 7/1061; E05D 2007/128; E05D 2007/1094; E05D 11/10; E05D 11/1007; E05D 11/1014; E05D 11/1021; E05D 3/06; E05D 3/08; E05D 2900/20; Y10T 292/216; Y10T 292/0894; Y10T 292/09; Y10T 292/0911; Y10S 292/49; Y10S 292/38; Y10S 16/257; Y10S 16/258; Y10S 16/321; Y10S 16/324; Y10S 16/326; Y10S 16/332; Y10S 16/343
See application file for complete search history.

(56) References Cited

U.S. PATENT DOCUMENTS

| | | | | |
|---|---|---|---|---|
| 10,820,701 | B2 | 11/2020 | Sobolewski et al. | |
| 10,881,207 | B2 * | 1/2021 | Sobolewski | F16B 12/14 |
| 2002/0093203 | A1 * | 7/2002 | Moretz | E05C 17/32 292/113 |
| 2012/0102842 | A1 * | 5/2012 | Fournie | E05C 19/145 292/200 |
| 2017/0043455 | A1 | 2/2017 | Sohn | |
| 2017/0260782 | A1 * | 9/2017 | Kim | E05B 13/002 |
| 2019/0316398 | A1 * | 10/2019 | Kruedener | E05D 15/46 |
| 2020/0362612 | A1 * | 11/2020 | Nordieker | E05D 3/16 |
| 2021/0010311 | A1 | 1/2021 | Nordieker et al. | |
| 2021/0115714 | A1 * | 4/2021 | Duer | E05D 5/0276 |
| 2021/0148149 | A1 * | 5/2021 | Pleuteri | E05D 3/12 |

FOREIGN PATENT DOCUMENTS

| | | | | |
|---|---|---|---|---|
| DE | 202017002159 | U1 * | 9/2018 | |
| EP | 2478175 | B1 * | 8/2014 | E05C 3/048 |
| EP | 2955305 | A1 * | 12/2015 | B64D 29/06 |
| GB | 1044911 | A | 10/1966 | |
| GB | 1194987 | A * | 6/1970 | |
| WO | 2018192819 | A1 | 10/2018 | |

OTHER PUBLICATIONS

International Search Report dated Apr. 9, 2020 in related/corresponding International Application No. PCT/EP2020/052258.
Search Report created Jul. 2, 2019 in related/corresponding DE Application No. 10 2019 102 491.9.
Written Opinion dated Apr. 9, 2020 in related/corresponding International Application No. PCT/EP2020/052258.

* cited by examiner

FLAP FITTING FOR FURNITURE

BACKGROUND AND SUMMARY OF THE INVENTION

Exemplary embodiments of the invention relate to a flap fitting for a piece of furniture, which comprises a lever mechanism having a plurality of levers for guiding a flap of the piece of furniture, wherein the lever mechanism is at least partially retracted into a housing of the flap fitting in a closed position.

Flap fittings are used on furniture, for example kitchen furniture and in particular wall cabinets, to close a furniture carcass that is usually open at the front with a guided flap. A flap differs from a door in the orientation of its pivot axis, which is vertical in the case of doors and horizontal n the case of flaps. The flap can be a single piece or consist of several individual parts, as in the case of a folding flap, for example, in which various parts of the flap move relative to one another in the course of movement.

For guiding doors, door hinges are usually used, which are arranged on the side of the pivot axis between the furniture carcass and the door. A comparable arrangement of hinges can in principle also be used for flaps. However, it is often desirable to open the flaps with a combined pivoting and sliding movement in order to obtain, for example in the case of a wall cabinet, the greatest possible access to the interior without the flap having to be pivoted to a horizontal position in which it cannot be reached by the user for closing, or only with difficulty. For this reason, certain flap fittings have become established that are not arranged along the pivot axis between the furniture carcass and the flap, but are arranged laterally on (usually both) side areas of the furniture carcass.

A furniture carcass with flap fittings that are not mounted on a side wall of the furniture carcass but are integrated into the side wall of the furniture carcass is known from DE 10 2017 104 169 A1. The flap fittings are characterized, on the one hand, by a very compact, in particular very thin design and, on the other hand, in that the substantially entire lever mechanism of the flap fitting, which guides the mounted flap, retracts completely or almost completely into a housing of the flap fitting in a closed state of the flap fitting, in the context of this application, the closed state of the flap fitting is understood to be a state in which the opening of the furniture carcass is closed by a mounted flap.

Such a flap fitting (or even a furniture carcass in which the flap fitting is integrated) is delivered in its closed state. Because the lever mechanism is essentially completely retracted into an opening in the housing of the fitting, it is then difficult to move the lever mechanism of the flap fitting out of the housing in order to be able to mount the flap. Frequently, the flap fitting is also equipped with an automatic closing mechanism that retracts the lever mechanism into the closed position under spring force when a certain closing angle is reached. The lever mechanism is then held in the housing by spring force in the closed position, which makes it even more difficult to move the lever mechanism out. In addition, there is a risk that the lever mechanism could be unintentionally moved out of the housing by unintentional application of force to the lever mechanism or by acceleration forces during transport or installation of the flap fitting. If, in addition to an automatic closing mechanism, the flap fitting is also equipped with an automatic opening mechanism which moves the lever mechanism into a fully open position when a certain opening angle is exceeded, unintentional movement of the lever mechanism out of the housing can pose a risk of injury.

Document DE 20 2014 103 519 U1 describes a flap fitting having a locking pin that can be inserted into a housing opening and prevents unintentional extension of a lever. The locking pin itself is latched in the housing to prevent it from falling out during transport. The locking of the securing pin can be released by a manual movement of the lever. However, such a locking mechanism is unsuitable for a flap fitting in which the lever mechanism essentially retracts into an opening in the housing, due to the described difficulty of manually pulling the lever mechanism out of the housing while a flap is not yet mounted.

Exemplary embodiments of the present invention are directed to a flap fitting of the type mentioned above, the lever mechanism of which can easily be extended manually even without the flap mounted.

A flap fitting of the type mentioned above according to the invention is characterized in that an auxiliary element with a connecting section is detachably and pivotably attached to one of the levers of the lever mechanism in order to extend the lever mechanism from the opening by pulling the auxiliary element.

The auxiliary element thus represents a tool with which the lever mechanism can be easily pulled out of the housing of the flap fitting. By attaching the auxiliary element to one of the levers, preferably the outer one of the levers, a pull can be applied directly to the lever mechanism without the danger of slipping off which exists, for example, if an attempt is made to grip the lever mechanism with pliers or the like. Preferably, the auxiliary element as well as the lever mechanism is arranged within the housing in the as-delivered condition in such a way that it does not protrude beyond housing edges so as not to interfere with installation or transport of the flap fitting. However, due to the pivotable connection with the lever mechanism, the auxiliary element can be easily moved out of the housing in this case—in contrast to the lever mechanism itself, which is usually subjected to spring force by a locking mechanism. Due to the detachable connection of the auxiliary element to the lever mechanism, the auxiliary element can be removed as soon as the lever mechanism has been pulled out of the housing and the auxiliary element has thus completed its service.

It is noted that, within the scope of the application, each element surrounding the lever mechanism in the closed state is to be considered a housing of the flap fitting. For example, spaced-apart and parallel side plates of the flap fitting may form its housing. If the flap fitting is integrated into a furniture panel n such a way that its lever mechanism extends out of an end opening of the furniture panel, the furniture panel also constitutes a housing of the flap fitting or is part of the housing of the flap fitting.

In an advantageous design of the flap fitting, the auxiliary element has a locking section that blocks movement of the lever relative to the housing in a locking position, in this way, the auxiliary element, in addition to its function as a pull-out aid, also assumes a securing function to prevent the lever mechanism from extending unintentionally. Since the auxiliary element, unlike the securing elements known from the prior art, is not attached to the housing, but is instead attached to the lever itself in reverse, it can use a locking section to block movement of the lever relative to the housing, in contrast to the known securing elements, this results in the advantage that after manual release of the locking relative to the housing, the auxiliary element itself, which is then still attached to the lever, can be used as a pull-out aid for the lever and thus the lever mechanism.

In one design, the connecting section may be hinged to the locking section for this purpose. Preferably, in a locking position, the connecting section and the locking section are aligned substantially parallel to each other, with the locking section engaging behind a section of the housing. When the locking is then released, the connecting section and the locking section are aligned transversely with respect to each other in a removal position in which the lever mechanism on the auxiliary element can be extended from the housing. Preferably, the connecting section and the locking section latch together in the locking position. This prevents accidental unlocking. For latching, the connecting section or the locking section has a latching mechanism comprising, for example, a resilient tab with a latching lug.

In another advantageous design of the flap fitting, a release opening is provided for insertion of a tool to release the latching. For example, the release opening may be adjacent the resilient tab for use of the tool to move the tab away from a latching partner. By requiring the use of a tool, the risk of inadvertent unlocking is particularly low. The entire auxiliary element, including the latching mechanism, can be arranged within the housing by providing the release opening. As an alternative to the release opening into which the tool is inserted, the resilient tab can also be positioned in such a way that the latching can be released directly or indirectly without a tool, for example by pressure with a finger.

In a further design of the flap fitting, the connecting section has a fork head by which the auxiliary element is engaged with a pin-like fastening element on the lever chain for fastening in the closed position. Such a fastening element is often provided on the lever chain to hook or engage a mounting plate to which the flap to be guided is mounted. This fastening element is well suited for pivotally connecting the auxiliary element to the lever chain. Preferably, the fork head is then designed to be detachable from the fastening element by a rotary movement. The rotary movement is different from the pulling movement with which the lever chain is pulled out of the housing, so that there is no danger of the auxiliary element becoming detached while the pull is being exerted.

BRIEF DESCRIPTION OF THE DRAWING FIGURES

Figure 3:
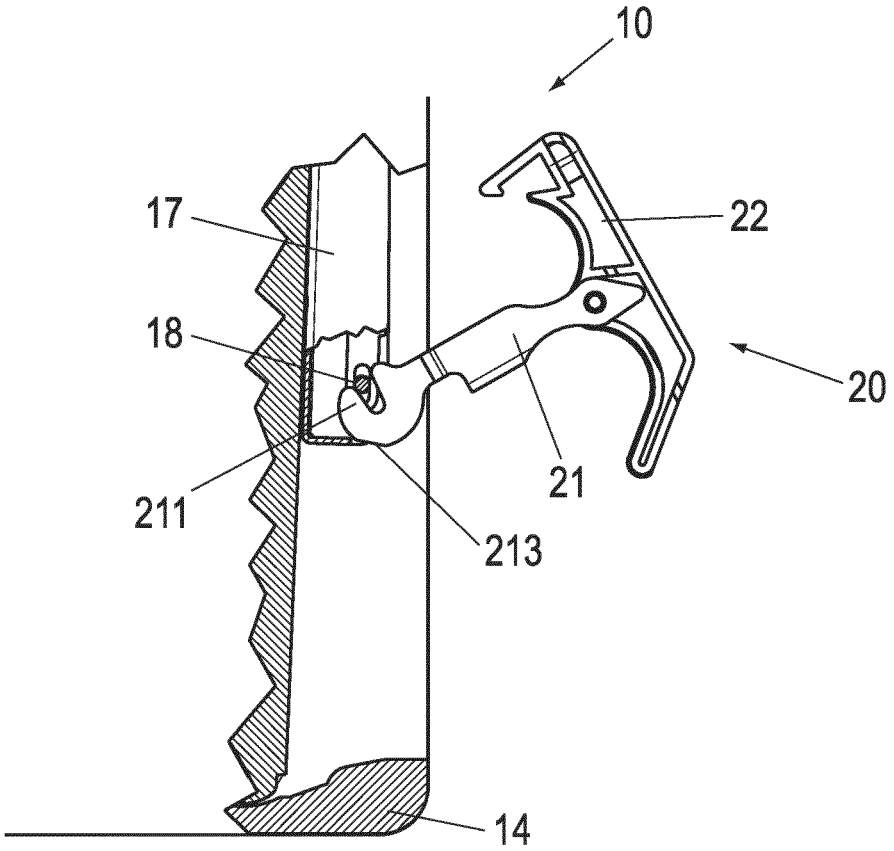
Figure 4B:
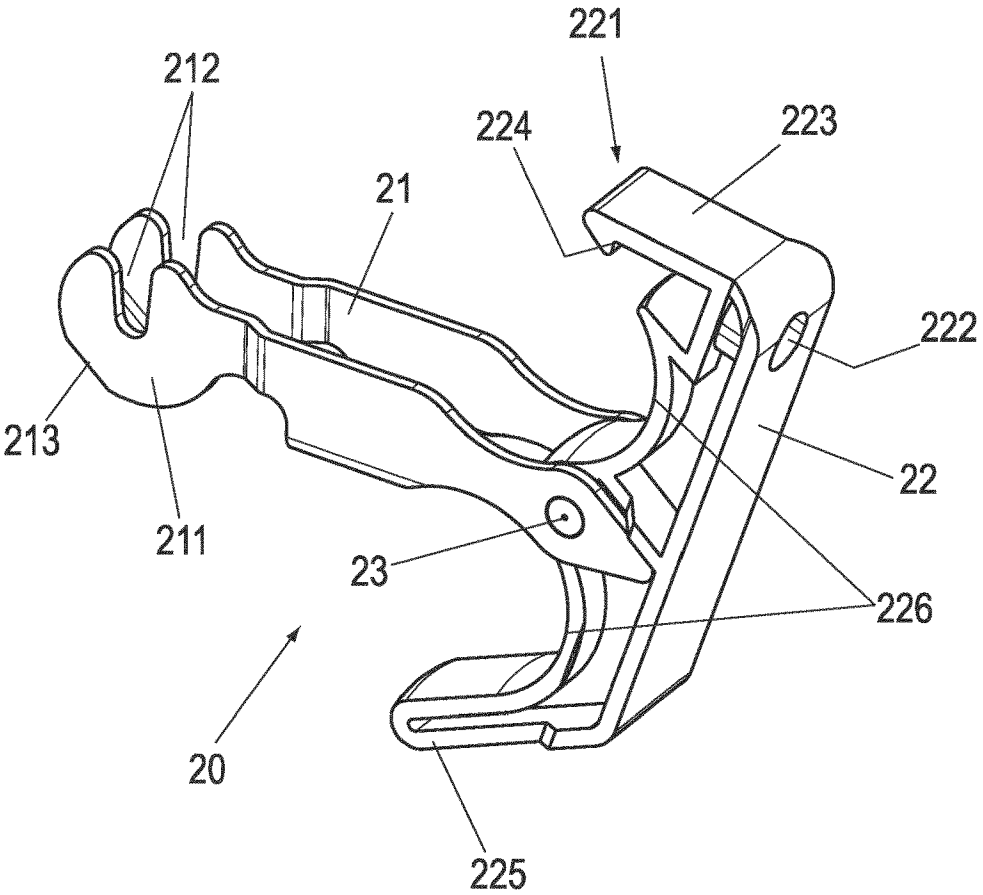
Figure 4A:
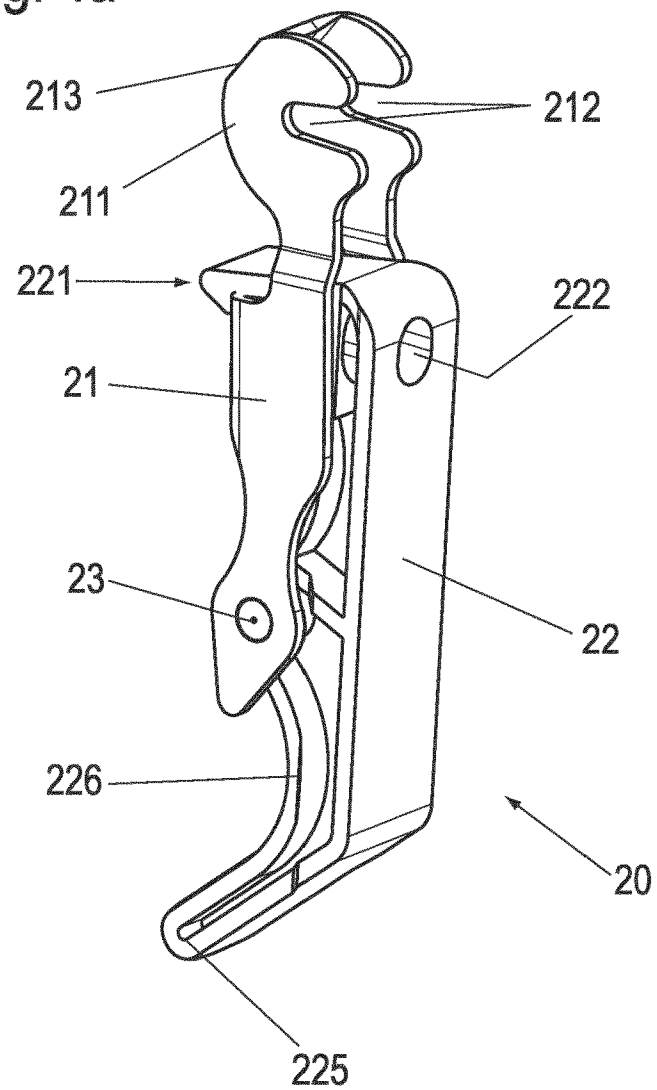

The invention is explained in more detail below by means of exemplary embodiments with the aid of figures, wherein:

FIG. 1 shows a side view of a flap fitting with an auxiliary element in an as-delivered condition;

FIG. 2*a*-2*i* show a representation of the flap fitting with auxiliary element analogous to FIG. 1 in various stages of a process for unlocking and extending the lever mechanism;

FIG. 3 shows a representation of the flap fitting with auxiliary element analogous to FIG. 1 for unlocking with retracted lever mechanism;

FIG. 4*a* shows an isometric representation of an auxiliary element for a flap fitting in a locked state; and FIG. 4*b* shows an isometric representation of an auxiliary element for a flap fitting in an unlocked state.

DETAILED DESCRIPTION

FIG. 1 shows a side view of an exemplary embodiment of a flap fitting 10 according to the application.

In the description, terms such as above, below, left, right, behind or in front refer exclusively to the exemplary representation selected in the respective figures. The terms front and rear generally refer to an opening movement of a guided flap. The front side is a side facing the user.

The flap fitting 10 has a housing 11 with a front opening 12. The housing 11 of the flap fitting 10 is substantially cuboidal, wherein a thickness of the housing in the viewing direction of FIG. 1 is small compared to the visible dimensions in the drawing plane FIG. 1. In this respect, the housing 11 has more of the geometry of a flat plate. In the illustrated exemplary embodiment, three of the four corners of the housing 11 visible in FIG. 1 are rounded and the fourth corner is additionally flattened. This difference serves, among other things, to make it easier to recognize the orientation of the flap fitting 10 during its manufacture or assembly.

In the present case, the housing 11 of the flap fitting 10 is formed from two side plates 13 which are spaced apart from one another and aligned parallel to one another by a partially circumferential frame 14. The side plates 13 and the frame 14 can be held together, for example, by rivets or screws not shown here. Components of the flap fitting 10 not visible in FIG. 1 may also be mounted to the side plates and/or frame 14 by rivets or other fasteners. Rivets or bolts passing through both side plates 13 may serve both to hold the housing 11 together and to act as fastening elements or pivot pins for the other components of the flap fitting 10. Preferably, the side plates 13 are metal sheets and the frame 14 is a plastic injection molding. However, other combinations of materials are also possible.

The flap fitting 10 has a lever mechanism 16 which, in the illustrated closed state of the flap fitting 10, is positioned completely in the housing 11, i.e., between the side plates 13. Of the lever mechanism 16, only an outer lever 17 is partially visible in the illustration of FIG. 1, in that the side plate 13 facing the viewer is shown partially broken open.

The flap fitting 10 is preferably integrated in a furniture panel, wherein the front opening 12 of the housing 11 is accessible through a front opening of the furniture panel.

The flap guided by the flap fitting 10 is arranged on the outer lever 17 of the lever mechanism 16 shown, usually via a mounting plate. When the flap is opened, the lever mechanism 16 moves in a combined sliding and pivoting movement out of the housing 11 of flap fitting 10 in order to guide the flap into an open state. Analogous to the closed state, the open state of the flap fitting is hereinafter referred to as the position of the lever mechanism 16 in which a mounted flap is fully open.

In the as-delivered condition of the flap fitting 10, an auxiliary element 20 is connected to the outer lever 17. The auxiliary element 20 is shown in more detail below in connection with FIGS. 4*a* and 4*b*. It is of multi-part construction and has a connecting section 21 and a locking section 22, which are pivotably connected to one another about a pivot as 23. The pivot axis 23 is located in an end region of the connecting section 21 and a central region of the locking section 22.

In the deployment situation of the auxiliary element 20 in the as-delivered condition of the flap fitting 10, the connecting section 21 and the locking section 22 extend substantially parallel to each other so that the auxiliary element 20 assumes an elongated geometry. In this arrangement of the two sections 21, 22 with respect to each other, the auxiliary element 20 is locked by a latching mechanism 221 formed at an end region of the locking section 22. It latches with the connecting section 21. An opposite free end of the locking section 22 extends to the frame 14, specifically the locking section 22 thereby engages behind an undercut 15 of the frame 14.

In the illustrated state, the stretched auxiliary element 20 represents an extension of the outer lever 17 of the lever mechanism 16. The outer lever 17 has a pin-like fastening element 18 for a mounting element of the flap to be attached. It may be provided, for example, that the mounting element is hooked into or latched to the fastening dement 18. The auxiliary element 20 is also fastened to the pin-like fastening element 18, in this case with a slotted fork head 211 see, for example, FIGS. 4*a* and 4*b*).

The rear engagement of the undercut 15 prevents the outer lever 17 and thus the lever mechanism 16 from swinging out. Unintentional swinging out of the lever mechanism 16 during transport and/or assembly, for example due to high acceleration forces, is prevented by the auxiliary element 20 used.

FIGS. 2*a* to 2*i* show an unlocking and extending sequence by which the flap fitting 10 is unlocked and its lever mechanism 16 is extended. The individual partial images of the sequence are each formed in the manner of FIG. 1, i.e., as a side view of the partially broken open flap fitting 10. For the sake of clarity, the flap fitting 10 is only partially shown in each case, in FIGS. 2*a* and 2*b*, the auxiliary element 20 is also shown in section to make the unlocking process more transparent.

Figure 2A:
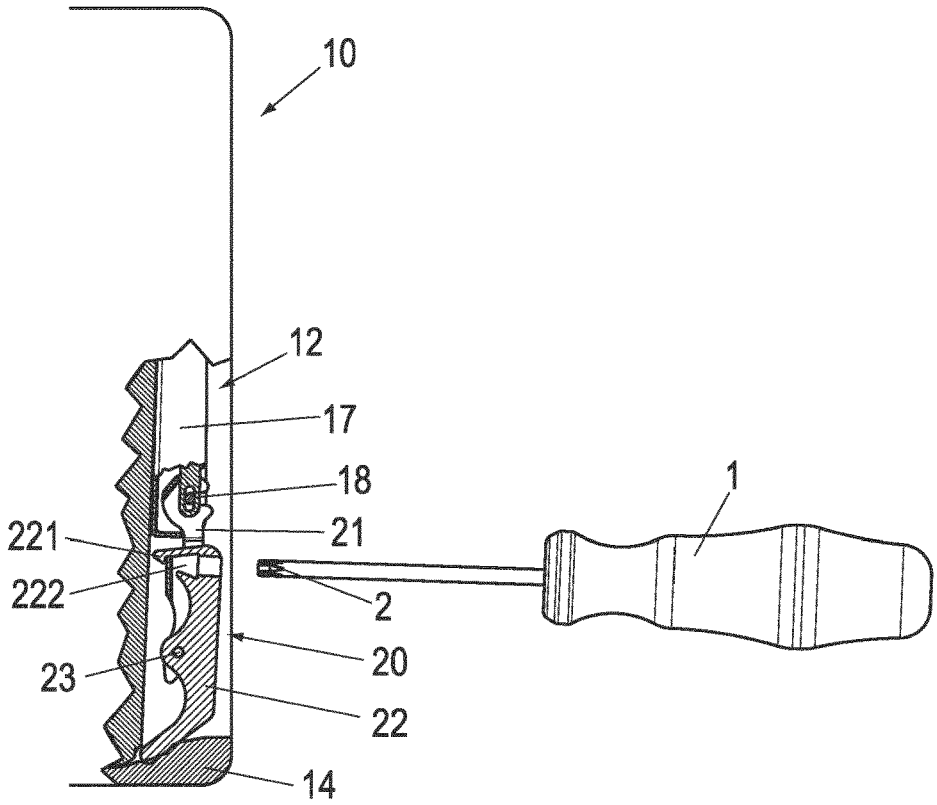

To unlock the auxiliary element 20, a tool 1 is first inserted with its tip 2 into a release opening 222 of the locking section 22, as shown in FIG. 2*a*. In the example shown, a multi-tooth screwdriver is used as the tool 1, i.e., a commonly available tool, not a special tool. Other tools with a comparable tip 2, such as a hex wrench, may also be used.

Figure 2B:
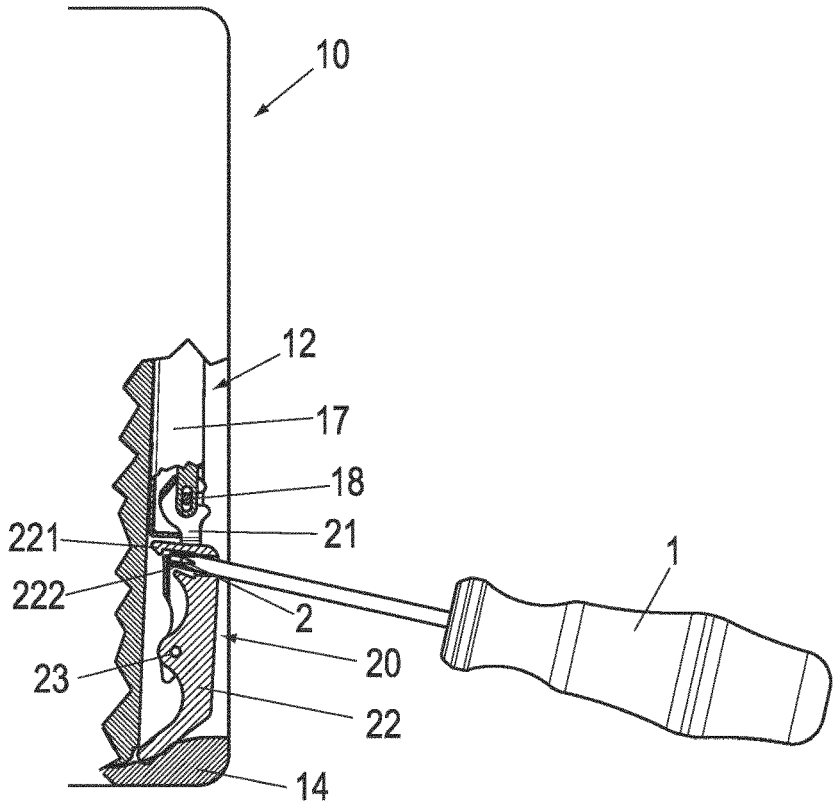
Figure 2C:
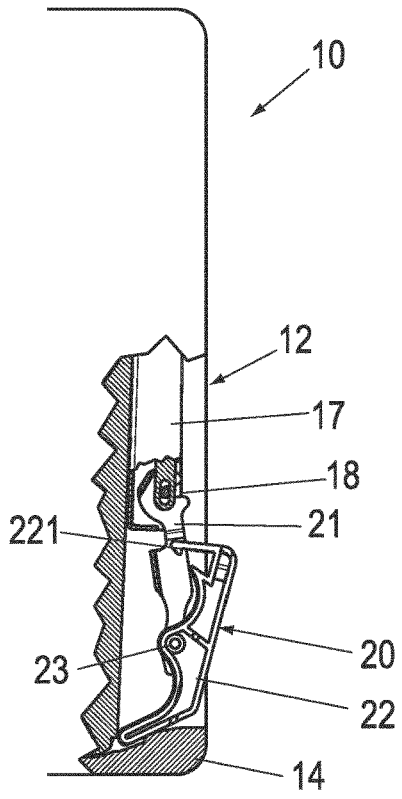
Figure 2D:
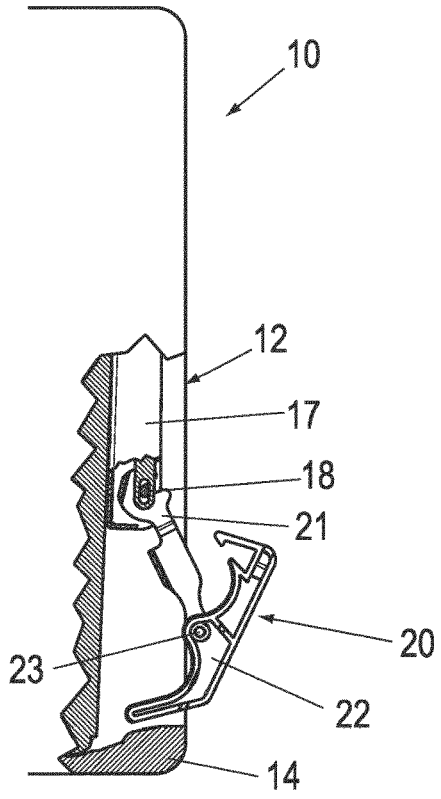

As FIG. 2*b* shows, a tilting movement of the tool 1 then releases the latching mechanism 221 and thus also the fixation of the auxiliary element 20 in the stretched geometry. Thereupon, the auxiliary element 20 can be angled out of the stretched orientation at the pivot axis 23, as shown in FIG. 2*c*. The tool 1 is no longer required from this moment on. The angled position of the locking section 22 with respect to the connecting section 21 moves the end of the locking section 22 out of the region of the undercut 15, thereby removing the securing of the lever mechanism 16. This is illustrated in FIGS. 2*d* and 2*e*.

Figure 2E:
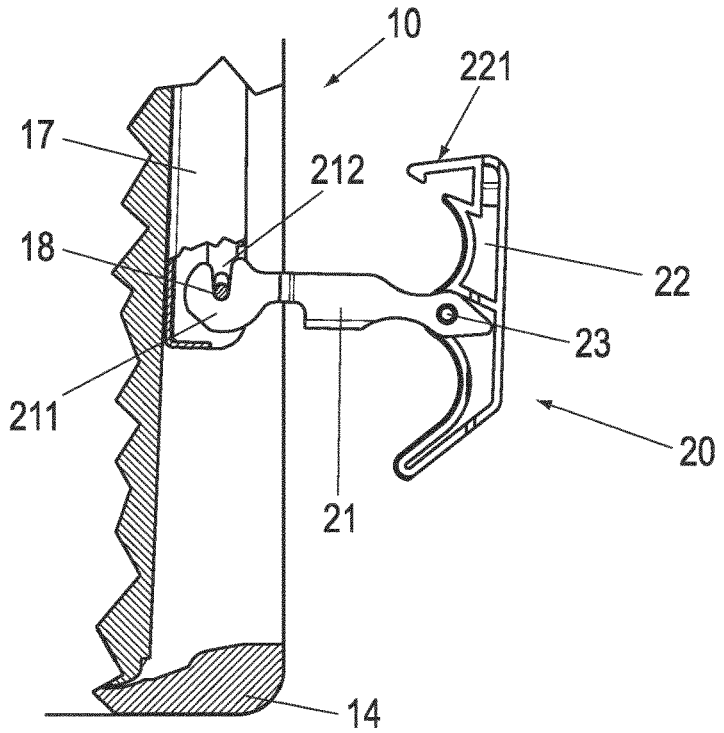

From the position shown in FIG. 2*e*, the lever mechanism 16 can be pulled out of the housing 11 by pulling on the locking section 22, which is now free and outside the side plates 13. When a pulling force is applied in the direction of the connecting section 21 in FIG. 2*e*, the auxiliary element 20 remains connected to the outer lever 17. This is due to the design of a slotted fork head 211 on the connecting section 21, as well as the pin-like fastening element 18 on the outer lever 17 in this case.

Figure 2F:
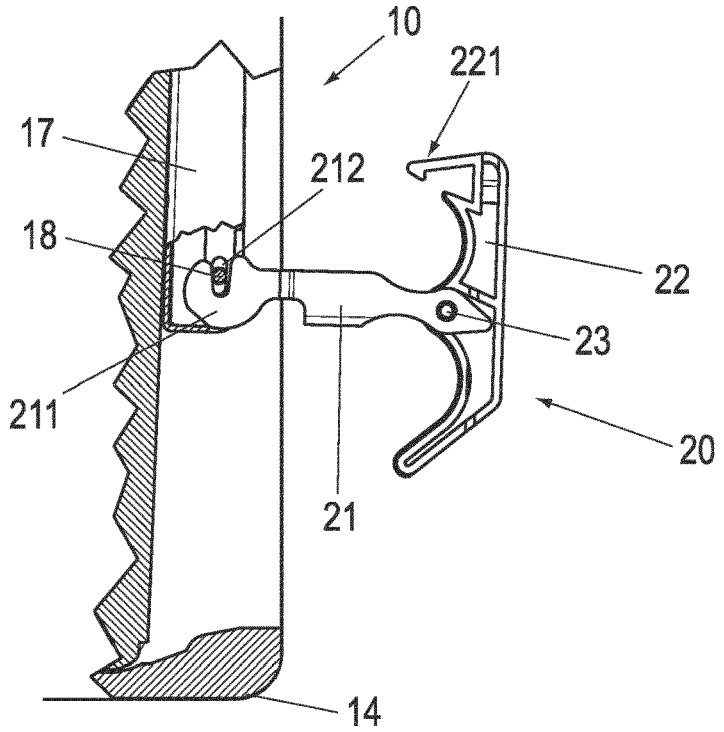
Figure 2G:
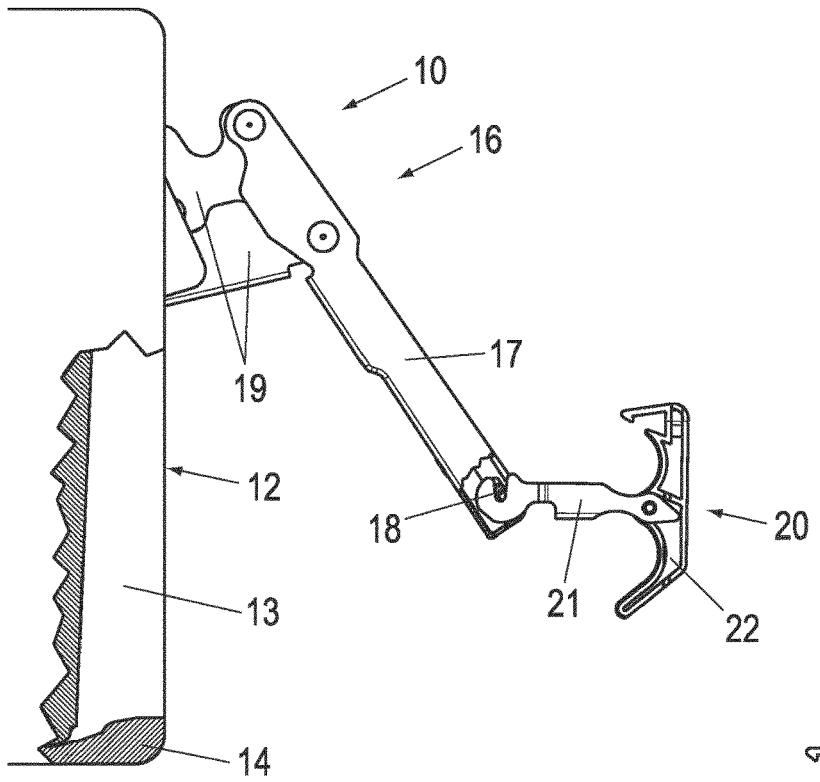
Figure 2H:
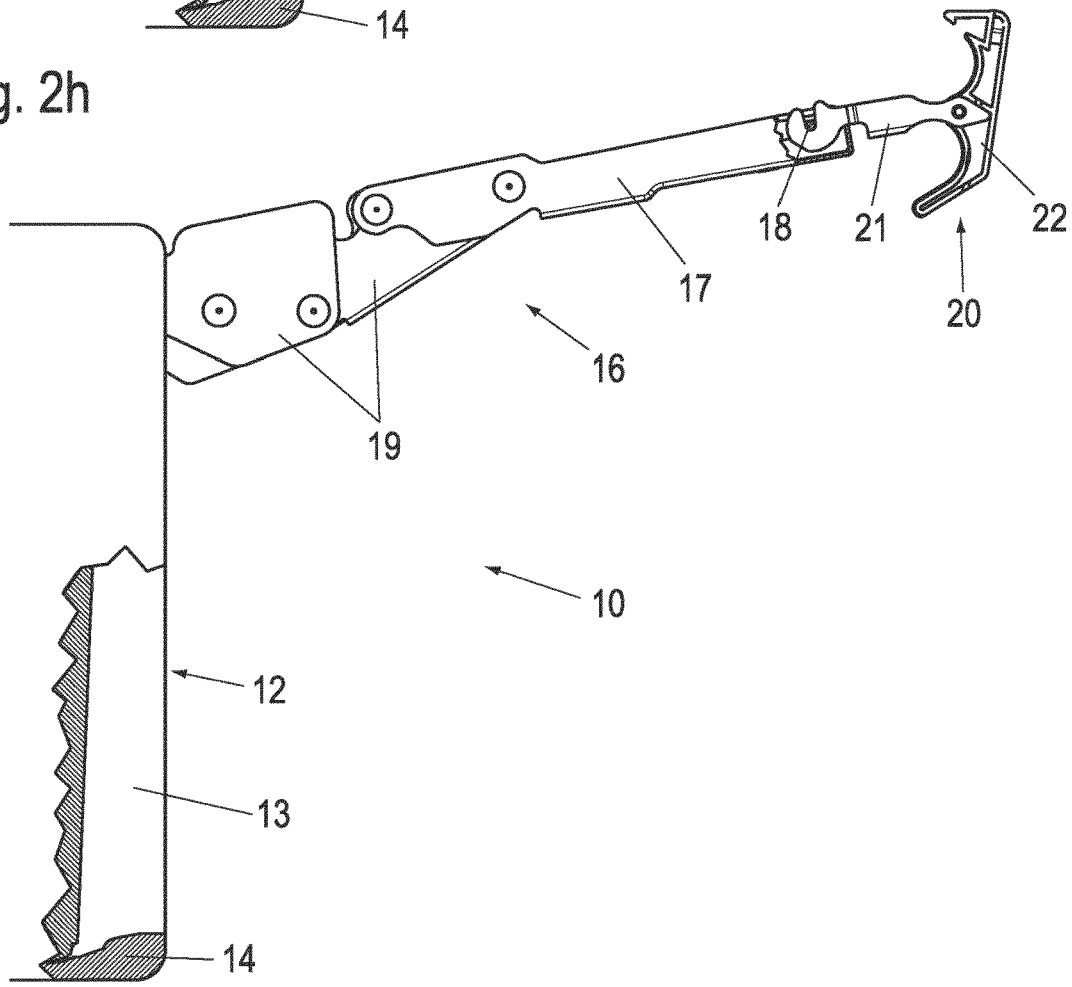
Figure 2I:
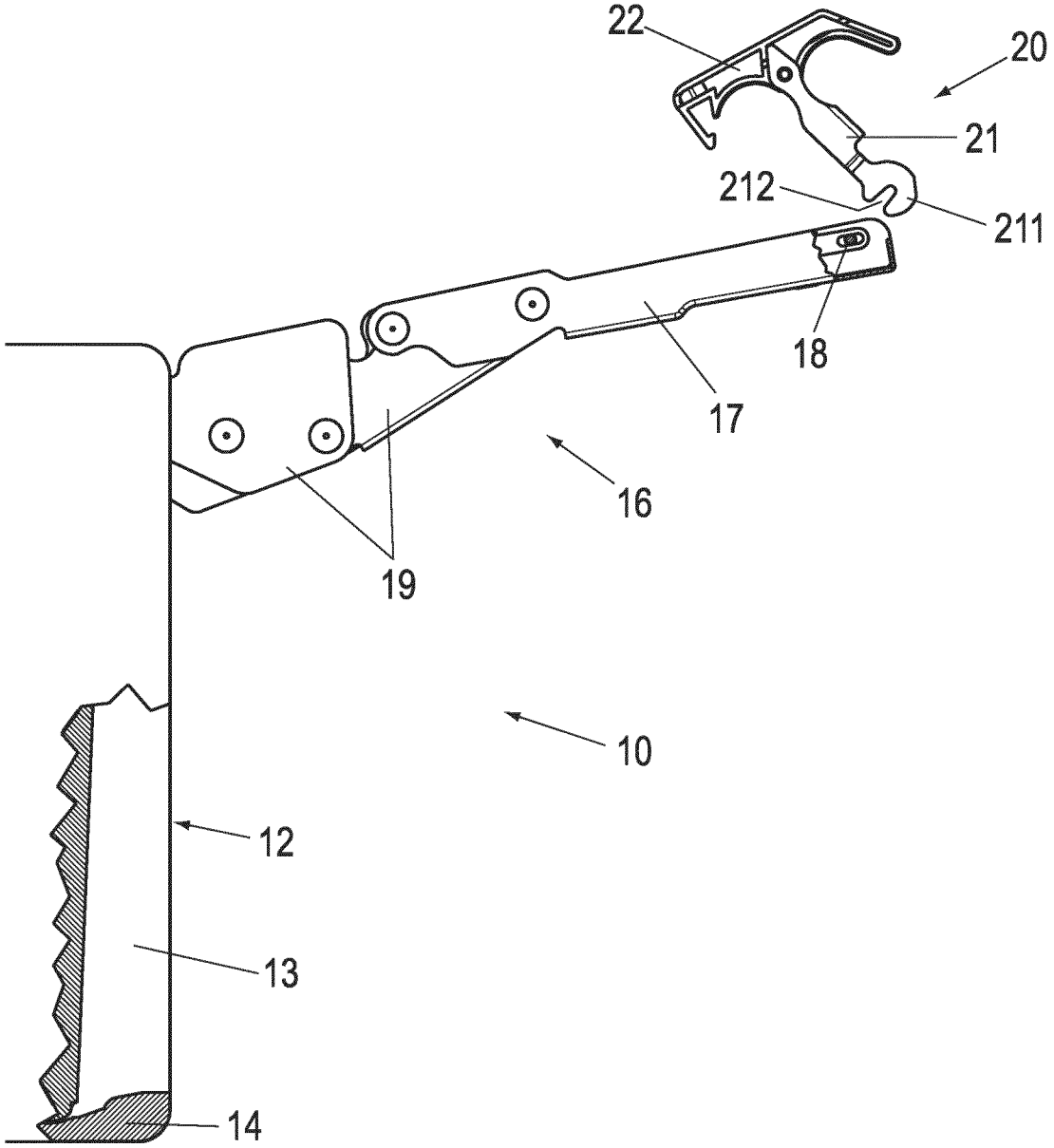

As can be seen from FIG. 2*f*, unintentional loosening of the connection between the connecting section 21 and the outer lever 17 is not possible in the shown orientation of the connecting section 21 relative to the outer lever 17. Accordingly, the lever mechanism 16 can be pulled out safely and without danger with the aid of the auxiliary element 20 even against acting pulling forces of an automatic closing mechanism of the lever mechanism 16 via a partially opened position (FIG. 2*g*) to the fully opened position (FIG. 2*h*). In FIGS. 2*g* and 2*h*, further levers 19 of the lever mechanism 16 are visible in addition to the outer lever 17. Finally, as shown in FIG. 2*i*, the auxiliary element 20 can be removed by turning it counterclockwise.

FIG. 3 shows that the auxiliary element 20 can also be removed after the safety catch has been released without first extending the lever mechanism 16 with the aid of the auxiliary element 20. For this purpose, the unlocking sequence of FIGS. 2*a* to 2*e* is first run through. Starting from the state shown in FIG. 2*e*, the auxiliary element 20 is rotated counterclockwise until the fork head 211 can be removed from the pin-like fastening dement 18. To make this possible with the given geometry of the outer lever 17 in the area of the fastening element 18, the fork head 211 is provided with a flattening 213 at a suitable location.

In FIGS. 4*a* and 4*b*, the auxiliary element 20 is shown separately in more detail, each in an isometric view. FIG. 4*a* shows the auxiliary element 20 in the elongated, locked geometry, FIG. 4*b* shows the auxiliary element 20 in the unfolded position, in which the lever mechanism 16 can be extended with the aid of the auxiliary element 20.

In the figures, the latching mechanism 221 can be seen in more detail. It is formed by as resilient tab 223, at the free end of which a latching lug 224 is formed. In the elongated and locked state shown in FIG. 4*a*, the latching lug 224 engages over a part of the connecting section 21. Preferably, the locking section 22 is integrally formed from an injection-molded plastic part. The resilient tab 223 may be integrally formed therewith. Likewise, the pivot axis 23 may be formed by projections that are also integrally molded.

The connecting section 21 is preferably made of sheet metal in a stamping and bending process. It is U-shaped in its basic structure with a base and legs, wherein the two legs are perpendicular to the pivot axis 23. In the stretched and locked state of the auxiliary dement 20, the U-shaped connecting section 21 partially embraces the locking section 22. The latching lug 224 of the locking section 22 engages over an edge of the base of the U-shaped connecting section 21. The fork head 211 is formed in both parallel legs of the connecting section 21. Reference numeral 212 indicates the aforementioned slots in fork head 211 in FIGS. 4*a* and 4*b*.

A latch 225 is formed at the end of the locking section 22 opposite the latch mechanism 221, with which the locking section 22 is positioned behind the undercut 15 of the flap fitting 10 for locking the lever mechanism 16. in addition, in order to provide a good grip on the locking section 22 when the lever mechanism 16 is pulled out, grip recesses 226 are formed on the rear side of the locking section 22.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE NUMERALS

1 Tool
2 Tip
10 Flap fitting
11 Housing
12 Front opening
13 Side plate
14 Frame
15 Undercut
16 Lever mechanism
17 Outer lever
18 Fastening element
19 Further lever
20 Auxiliary element
21 Connecting section
211 Fork head
212 Slot
213 Flattening
22 Locking section
221 Latching mechanism
222 Release opening
223 Tab
224 Latching lug
225 Latch
226 Grip recess
23 Pivot axis

The invention claimed is:

1. A flap fitting for a piece of furniture, the flap fitting comprising:

a housing;

a lever mechanism comprising a plurality of levers arranged to guide a flap of the piece of furniture, wherein the lever mechanism is at least partially retracted into the housing in a closed position and the lever mechanism is accessible through a front opening of the housing in an assembled state; and an auxiliary element with a connecting section is releasably and pivotably attached to one of the plurality of levers of the lever mechanism to extend the lever mechanism out of the front opening by pulling the auxiliary element.

2. The flap fitting of claim 1, wherein the auxiliary element comprises a locking section that blocks movement of the plurality of levers relative to the housing in a locked position.

3. The flap fitting of claim 2, wherein the connecting section is hingedly connected to the locking section.

4. The flap fitting of claim 3, wherein the connecting and locking sections are aligned parallel to each other in the locked position, wherein the locking section engages behind a section of the housing.

5. The flap fitting of claim 3, wherein the connecting and locking sections are aligned transversely with respect to each other in a removal position in which the lever mechanism on the auxiliary element is extendable from the housing.

6. The flap fitting of claim 2, wherein the connecting and locking sections latch together in the locked position.

7. The flap fitting of claim 6, wherein for latching, the connecting section or the locking section comprises a latching mechanism.

8. The flap fitting of claim 7, wherein the latching mechanism comprises a resilient tab having a latching lug.

9. The flap fitting of claim 8, wherein a release opening is provide in the locking section for insertion of a tool to release the latching.

10. The flap fitting of claim 9, wherein the release opening is adjacent the resilient tab to move the tab away from a latching partner with the tool.

11. The flap fitting of claim 8, wherein the resilient tab is positioned to allow the latching to be released directly or indirectly without the use of a tool.

12. The flap fitting of claim 1, wherein the connecting section comprises a fork head by which the auxiliary element is engaged with a pin-like fastening element on a lever chain of the lever mechanism for fastening in the closed position.

13. The flap fitting of claim 12, wherein the fork head is configured such that it is disengageable from the fastening element by a rotational movement.

14. The flap fitting of claim 1, wherein the one of the plurality of levers to which the auxiliary element is attached is an outer lever of the lever mechanism.

* * * * *